US005908577A

United States Patent [19]

Yamamura et al.

[11] Patent Number: 5,908,577

[45] Date of Patent: Jun. 1, 1999

[54] NOZZLE FOR CONTINUOUS CASTING

[75] Inventors: Takashi Yamamura; Osamu Nomura; Masamichi Takai; Toshio Horiuchi, all of Okayama, Japan

[73] Assignee: Shinagawa Refractories Co., Ltd., Tokyo, Japan

[21] Appl. No.: 08/915,600

[22] Filed: Aug. 21, 1997

[30] Foreign Application Priority Data

Aug. 26, 1996 [JP] Japan ..... 8-224156

[51] Int. Cl.[6] ..... B22D 11/10

[52] U.S. Cl. ..... 222/606; 501/100

[58] Field of Search ..... 222/590, 591, 222/606, 607; 501/99, 100

[56] References Cited

U.S. PATENT DOCUMENTS

| | | | |
|---|---|---|---|
| 4,059,662 | 11/1977 | Murakami et al. | 222/606 |
| 4,210,264 | 7/1980 | Kondo | 222/606 |
| 5,259,596 | 11/1993 | Ruffaldi | 222/606 |
| 5,691,061 | 11/1997 | Hanse et al. | 222/606 |

FOREIGN PATENT DOCUMENTS

| | | |
|---|---|---|
| 0423793 | 4/1991 | European Pat. Off. . |
| 0589762 | 3/1994 | European Pat. Off. . |
| 51-54836 | 5/1976 | Japan . |
| 56-139260 | 10/1981 | Japan . |
| 63-203258 | 8/1988 | Japan . |
| 2-23494 | 5/1990 | Japan . |
| 3-243258 | 10/1991 | Japan . |
| 5-154628 | 6/1993 | Japan . |
| 8-57601 | 3/1996 | Japan . |
| 8-57613 | 3/1996 | Japan . |
| 2135918 | 9/1984 | United Kingdom . |

OTHER PUBLICATIONS

Database WPI Section Ch, Week 8804 Derwent Publication Ltd., London, GB; Class L02, AN 88–026267 and JP–A–62–288161 (No Date).

Patent Abstracts of Japan vol. 009, No. 121 (M–382), May 25, 1985.

Patent Abstracts of Japan vol. 018, No. 650 (M–1719), Dec. 9, 1994.

Patent Abstracts of Japan vol. 005, No. 061 (M–065), Apr. 24, 1981.

Patent Abstracts of Japan vol. 013, No. 373 (M–861), Aug. 18, 1989.

Patent Abstracts of Japan vol. 015, No. 413 (C–0877), Oct. 22, 1991.

*Primary Examiner*—Scott Kastler

*Attorney, Agent, or Firm*—Sughrue, Mion, Zinn Macpeak & Seas, PLLC

[57] ABSTRACT

A nozzle for continuous casting which is prevented from clogging due to alumina deposition is disclosed, wherein the inner wall member is made of a refractory material having a carbon content of 1% to 10% by weight; a material other than carbon in the refractory material has a grain size of not more than 420 $\mu$m; the inner wall member is integrally molded with the outer nozzle body to form an integral structure; and said inner wall member has a thickness of 2 mm to 12 mm.

7 Claims, 1 Drawing Sheet

NOZZLE FOR CONTINUOUS CASTING

FIELD OF THE INVENTION

This invention relates to a nozzle for continuous casting. More particularly, it relates to a nozzle for continuous casting, such as a long nozzle and a submerged nozzle, which is effectively prevented from clogging and which can be produced by integral molding.

BACKGROUND OF THE INVENTION

Conventional nozzles for continuous casting of steel are often made of alumina-graphite refractories. Nozzles for continuous casting include a long nozzle and an air seal pipe which are used between a ladle and a tundish and a submerged nozzle used between a tundish and a mold. These nozzles are strictly required to have corrosion resistance against molten steel or slag and spalling resistance in nature of the condition of their use. For the time being, alumina-graphite materials have been of wide use to cope with these requirements.

Where a nozzle made of alumina-graphite materials is used, particularly for casting aluminum killed steel having a high aluminum content, alumina ($Al_2O_3$) resulting from oxidation of aluminum deposits on the inner wall of the nozzle to cause clogging.

Multiple continuous casting has recently been spreading for improving productivity. If a nozzle is clogged due to alumina deposition (adhesion) in multiple continuous casting, the flow of molten steel can no more be controlled, making it difficult to continue casting.

The clogged obstruction sometimes comes off the inner wall of the nozzle during casting. In this case, the obstruction enters the mold and is incorporated into cast steel to cause casting defects.

It seems that deposition of alumina onto a nozzle proceeds through the reactions between aluminum in molten steel and the refractories constituting a submerged nozzle, represented by the following reaction formulae.

(1) $SiO_2$ (s)+C (s)=SiO (g)+CO (g)

(2) 3SiO (g)+2Al=$Al_2O_3$ (s)+3Si (3) 3CO (g)+2Al=$Al_2O_3$ (s)+3C

At first, the reaction represented by formula (1) takes place between $SiO_2$ (s) and C (s) present in the refractories to generate SiO (g) and CO (g). Subsequently, the reactions represented by formulae (2) and (3) occur between Al in molten steel and the produced SiO (g) and CO (g) to form $Al_2O_3$ (s), which is deposited (adhered) on the surface of the inner wall of a nozzle. Alumina in molten steel is gradually accumulated on the thus produced alumina seed, finally blocking the nozzle.

Various methods have been studied and proposed as a means for preventing such nozzle clogging. For example, gas blowing is generally adopted as an effective means for preventing nozzle clogging.

Gas blowing is a method in which the inner wall of, e.g., a submerged nozzle is made of porous refractories, and gas (e.g., argon) is blown through the open pores to inhibit alumina from depositing on the inner wall. This method is effective on prevention of nozzle clogging and is adopted in many steel works.

However, while gas is made to flow in a sufficient amount enough to prevent nozzle clogging, fine gas bubbles tend to enter the mold to cause casting defects. Further, the gas causes the bath level of molten steel to vary considerably. As a result, the molten steel tends to take up inclusions which will cause defects of cast steel.

In addition to gas blowing, use of CaO-containing zirconia clinker is also known as a countermeasure to clogging as disclosed in JP-B-2-23494 (the term "JP-B" as used herein means an "examined published Japanese patent application"). According to this method, $Al_2O_3$ particles precipitated in molten steel are reacted with CaO present in zirconia clinker to produce CaO—$Al_2O_3$-based low-melting compounds, which are removed along with the flow of molten steel, thereby to prevent alumina deposition.

The method of using zirconia clinker is considered effective on prevention of alumina deposition. In fact, a submerged nozzle whose inner wall is made up of a material containing CaO-containing zirconia clinker is used in a large number of continuous casting machines.

However, a nozzle using CaO-containing zirconia clinker is inferior in spalling resistance because CaO-containing zirconia clinker has a large thermal expansion coefficient and, being laid on the inner side of the nozzle, generates a great thermal stress on the outer side of the nozzle in the initial stage of casting.

On the other hand, JP-A-3-243258, JP-A-5-154628, JP-A-8-57601, and JP-A-8-57613 (the term "JP-A" as used herein means an "unexamined published Japanese patent application") mention that clogging of a nozzle can be prevented by making the inner wall and other parts of the nozzle which come into contact with molten steel by using an oxide material having no or, if any, less than 1% by weight of, carbon. The publications describe that use of oxides, such as alumina or magnesia, at the parts coming into contact with molten steel is effective in preventing alumina deposition or carbon pickup.

However, since any of the materials used in the above-described methods contains substantially no carbon source, it necessarily has a high thermal expansion coefficient, resulting in poor spalling resistance.

Referring to the poor spalling resistance of these materials, JP-A-8-57601 and JP-A-3-243258 supra propose molding the inner wall part and other parts coming into contact with molten steel separately from the nozzle body of the nozzle and, after completing the nozzle body, laying the inner wall part, etc. by slip casting or injecting the oxide material or inserting a sleeve brick made of the oxide material. However, the separate molding method for producing a nozzle for continuous casting is very complicated, involving an increased number of steps and incurring a high cost of production.

JP-A-51-54836 also discloses a submerged nozzle whose inner wall part is made up of a carbon-free material. The material used here contains 90% by weight or more of $SiO_2$ and therefore suffers a considerable corrosion in casting.

JP-A-63-203258 discloses a material having a carbon content of not more than 20% by weight. In the publication, however, no consideration is given to the grain size distribution of the raw materials used and the thickness of the inner wall part, and the material disclosed is unsatisfactory in thermal shock resistance.

Additionally, application of materials other than oxides to a nozzle is disclosed in JP-A-56-139260, in which a material containing 5% to 80% by weight of boron nitride is used.

In brief, conventional techniques for preventing clogging of a nozzle due to deposition of alumina include (1) gas blowing, (2) reaction between alumina in molten steel and the content (CaO content) in the nozzle material to form a low-melting compound, (3) molding the inner wall part by slip casting or injecting a carbon-free refractory material, but they have their several disadvantages.

SUMMARY OF THE INVENTION

An object of the present invention is to provide a nozzle for continuous casting that is effectively prevented from clogging and can be produced by integral molding.

The inventors of the present invention have found that deposition of alumina on the inner wall part (member) of a submerged nozzle in continuous casting of steel can be reduced, and corrosion of the nozzle by molten steel can be suppressed, by making the inner wall part of the nozzle of a carbon-containing refractory material having a carbon content of 1% to 10% by weight with the raw materials other than carbon having a grain size of not greater than 420 $\mu$m. The present invention is characterized in that the inner wall part of the nozzle can be integrally molded with the nozzle body.

The present invention provides a nozzle for continuous casting comprising an inner wall part and a (outer) nozzle body wherein the inner wall part coming into contact with molten steel is made of a refractory material having a carbon content of 1% to 10% by weight; raw materials of the refractory material other than carbon have a grain size of not more than 420 $\mu$m; the inner wall part having been integrally molded with the outer nozzle body to form an integral structure; the inner wall part has a thickness of 2 mm to 12 mm (corresponding to claim 1).

In a preferred embodiment of the nozzle according to the present invention, the refractory material forming the inner wall part comprises carbon and an oxide (corresponding to claim 2). In a still preferred embodiment, the oxide contains cordierite in an amount of 5% to 70% (corresponding to claim 3).

In another preferred embodiment of the nozzle according to the present invention, the refractory material forming the inner wall part comprises (A) carbon and a nitride, (B) carbon, a nitride and an oxynitride, or (C) carbon, a nitride, a oxynitride and an oxide (corresponding to claim 4).

In a yet preferred embodiment of the present invention, a space is provided on the outer side of the refractory material forming the inner wall part (corresponding to claims 5–8).

DETAILED DESCRIPTION OF THE INVENTION

Figure 1:
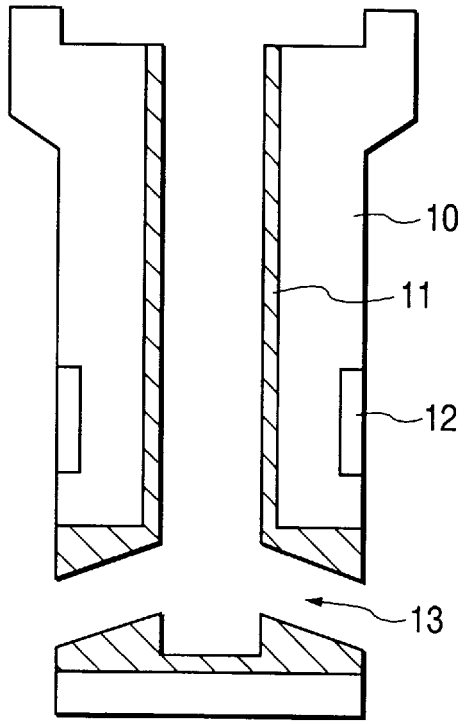
FIG. 1 is a longitudinal section of a submerged nozzle.

The inner wall part of the nozzle according to the present invention is made of a refractory material having a carbon content of 1% to 10% by weight.

As can be understood from reaction formula (1), according as the C content of a refractory material decreases, production of SiO (g) and CO (g) is reduced thereby to suppress production of $Al_2O_3$ (also see reaction formulae (2) and (3)). From this viewpoint, it seems preferable for the material forming the inner wall part not to contain carbon at all. To the contrary, the carbon content of the refractory material used in the present invention is limited to the range of from 1% to 10% by weight, preferably 1% to 8% by weight, for the following reason.

If the carbon content exceeds 10% by weight, the effect in preventing deposition of alumina is considerably ruined. If it is less than 1% by weight, the thermal spalling resistance of the nozzle is seriously reduced, involving a danger of cracking at the time of casting.

As the carbon content decreases, the deposition of alumina generally tends to be reduced but, on the other hand, resistance to thermal spalling becomes lower. Accordingly, the carbon content should be adjusted within a range of from 1% to 10% by weight to control the thermal spalling resistance, considering casting condition of continuous casting machine and/or pre-heating condition of nozzles.

Carbon sources to be used include graphite, artificial graphite, carbon black, pitch, etc. These carbon sources may be used either individually or as a combination of two or more thereof. Carbon resulting from carbonization of a binder used for kneading the raw materials (e.g., a phenolic resin) also serves as a carbon source.

The carbon preferably has a grain size of not greater than 600 $\mu$m. Grains greater than 600 $\mu$m cause a considerable structural change when decarburization by oxidation takes place.

Examples of the refractory materials for forming the inner wall part other than carbon include oxides, nitrides, and oxynitrides. It was revealed that deposition of alumina can be inhibited by using these materials for forming the inner wall part.

Specific but non-limiting examples of the oxides are alumina, mullite, magnesia, spinel, zirconia, and cordierite. Oxides having a higher melting point than a steel melting temperature are preferred. Oxides whose melting point lower than the steel melting temperature, such as cordierite, eucryptite, and spondumene, can also be used in combination with the high-melting oxides.

Cordierite was found particularly effective in preventing deposition of alumina. Cordierite is a compound represented by formula: $2MgO{\cdot}2Al_2O_3{\cdot}5SiO_2$ and having a melting point of about 146° C., about 100° C. lower than the steel melting temperature. It seems that molten cordierite presents a liquid phase on the surface or inside of the inner wall part to suppress diffusion of SiO (g) or CO (g) from the nozzle body of the nozzle thereby to suppress formation of $Al_2O_3$ (see reaction formulae (1) to (3)).

Cordierite decomposes on melting into mullite and a liquid phase so that the amount of the liquid phase is not so large as to entertain the possibility of the whole inner wall part's being swept away by the flow of molten steel. Further, the thermal expansion coefficient of cordierite is as low as about ¼ that of alumina so that addition of cordierite provides the inner wall part with improved thermal shock resistance.

Cordierite is suitably added in an amount of 5% to 70% by weight based on the total weight of the refractory raw materials. If the amount of cordierite is less than 5% by weight, the preventive effect on alumina deposition is weak. If it exceeds 70% by weight, an excessive amount of a liquid phase is to be formed to reduce the strength of the inner wall part, involving the danger that the inner wall part is swept away by the molten steel.

While cordierite is theoretically represented by the formula $2MgO{\cdot}2Al_2O_3{\cdot}5SiO_2$, cordierite species containing a small amount of other minerals can be used in the present invention as well.

Examples of the nitrides include silicon nitride and boron nitride, and examples of the oxynitrides include sialon and silicon oxynitride.

Alumina deposition is suppressed when nitrides or oxynitrides are used. This seems to be because these compounds hardly contain $SiO_2$ thereby suppressing the reaction represented by formula (1). In addition, nitrides generally have a low thermal expansion coefficient. For example, silicon nitride has a thermal expansion coefficient of about $3\times10^{-6}$ (an average in the temperature range of from 25° to 1000° C.), which is relatively close to that of an $Al_2O_3$-carbon material used in the base material of a submerged nozzle. This is advantageous from the standpoint of thermal shock resistance.

The oxynitrides can be added in kneading the raw materials or can be produced through reaction on firing. For example, silicon nitride and $Al_2O_3$ react on firing to produce β-sialon, while silicon nitride, aluminum nitride, and an oxide of a rare earth element (e.g., yttrium oxide) produce α-sialon on firing. These reactions also proceed during steel casting.

The above-described nitrides can be used in combination with oxides. In this case, the material for the inner wall part preferably comprises 0% to 50% by weight of oxides (one or more oxides selected from $Al_2O_3$ and an oxide of a rare earth element), 50% to 90% by weight of silicon nitride, 0% to 20% by weight of aluminum nitride, 0% to 40% by weight of boron nitride, and 1% to 10% by weight of graphite.

The inner wall part material comprising these raw materials is converted to a refractory material containing oxides, nitrides and oxynitrides on being fired or heated by the heat of steel casting.

Although use of nitrides causes the problem of nitrogen pick-up, the corrosion of the continuous casting nozzle of the present invention is so slight that nitrogen pick-up can be minimized.

It is preferable that the raw materials other than carbon, such as oxides and nitrides, have a grain size of not greater than 420 μm. It is still preferred that the proportion of grains of 1 μm or less is not more than 20% by weight (particularly not more than 15% by weight), that of grains of more than 1 μm and not more than 44 μm is 10% to 85% by weight (particularly 20% to 75% by weight), and that of grains of more than 44 μm and not more than 420 μm is 15% to 90% by weight (particularly 20% to 80% by weight), each based on the total weight of the raw materials other than carbon in the refractory material.

If the grain size of the raw materials (other than carbon) is more than 420 μm, the ratio of the maximum grain size to the thickness of the inner wall part is so high that the mechanical strength is reduced. Moreover, the coarse grains tend to fall off during casting.

If the proportion of fine grains of 1 μm or less exceeds 20% by weight, the material is ready to undergo sintering during firing or by the heat of molten steel during casting to cause the inner wall part to shrink and separate from the nozzle body. If the proportion of grains having a size of more than 1 μm and not more than 44 μm is less than 10% by weight or more than 85% by weight, the gap among raw material grains in size is too large, reducing thermal shock resistance. If the proportion of grains of more than 44 μm and not more than 420 μm is less than 15% by weight or more than 90% by weight, the same problem arises.

The thickness of the inner wall part is preferably 2 mm to 12 mm. If it is less than 2 mm, there are dangerous cases in which the nozzle body is exposed during casting due to the corrosion of the inner wall part. If it exceeds 12 mm, the considerable thermal expansion of the inner wall part tends to cause cracking.

The thickness of the refractory material other than the inner wall part of the nozzle for continuous casting, such as the refractory material provided around the spouts and at the bottom of thereof, is not particularly limited.

An inner wall part made of a low-carbon material necessarily has poor spalling resistance due to the large thermal expansion coefficient of the material. That is, a great thermal stress is imposed on the outer wall part of the nozzle due to the thermal expansion of the inner wall part accompanying the steep temperature rise with the passage of molten steel particularly in the initial stage of casting, which is considered to result in destruction of the refractory.

In order to avoid this, JP-A-8-57601 supra proposes molding the inner wall part and the other parts coming into contact with molten steel separately from the nozzle body without subjecting to integral molding, by slip casting or injection with an expansion absorbing joint provided between these parts and the nozzle body material.

In the present invention, a space having a slit structure (gap) that is formed between the inner wall part and the nozzle body by integral molding of the inner wall part and the nozzle body was found to be an effective means for relaxing the thermal stress in the initial stage of casting. If the inner wall part and the outer surrounding part (nozzle body) are in direct contact, the outer part is unavoidably influenced by the expansion of the inner part. The slit structure between them is effective in relaxing the thermal stress, acting as an expansion absorbing joint.

The slit structure additionally produces a heat insulating effect. Since deposition of alumina is considered to be accelerated by reduction in temperature in the inner wall part, the slit structure seems to serve as a heat insulation layer to suppress diffusion of the heat thereby suppressing alumina deposition.

It is necessary that the slit structure be formed simultaneously with the molding of the inner wall part and the nozzle body by, for example, using a material that disappears on heating, such as paraffin paper.

The thickness of the slit is preferably 0.3 mm to 2.0 mm. If it is less than 0.3 mm, the expansion absorbing effect is small. If it exceeds 2.0 mm, the bonding force between the inner wall part and the nozzle body is weakened, tending to allow molten steel to enter the inside of the inner wall part.

Figure 2:
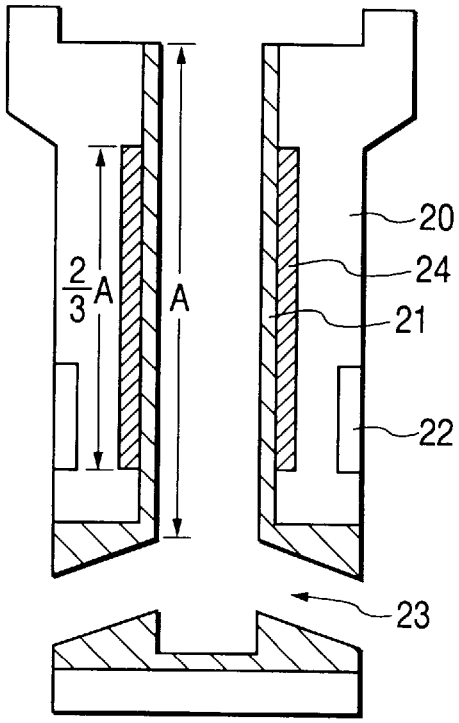
FIG. 2 is a longitudinal section of a submerged nozzle having a slit structure around the inner wall part thereof.

The length of the slit structure is preferably ¼ to 9/10 of the total length of the straight portion of the inner wall part (corresponding to A in FIG. 2). If it is shorter than ¼ of the total length, the effect in preventing cracking is small. If it exceeds 9/10 of the total length, the force of holding the inner wall part is so weak that the inner wall part tends to come off the nozzle body.

The slit structure can take a bridge structure in which the nozzle body and the inner wall part are partly contacted with each other. Such a bridge structure is effective in the case where the slit has a large length, in which case the inner wall part, held by a reduced force, may be pressed outward by molten steel and destroyed.

The area of the joints where the nozzle body and the inner wall part meet is preferably not more than ⅓ of the total area of the slit structure. If it exceeds ⅓ of the total area of the slit structure, the expansion absorbing effect of the slit is reduced, and the thermal shock resistance of the nozzle is reduced. The bridge structure is not particularly limited in shape.

The nozzle for continuous casting according to the present invention is not only markedly effective in preventing the nozzle clogging due to alumina deposition as stated above but also effective in suppressing carbon pick-up caused by corrosion because the carbon content of the lining refractory material (1% to 10% by weight) is lower than that of ordinary nozzles. Therefore, it is particularly advantageous to apply the refractory material used in the present invention (carbon-containing refractory material having a carbon content of 1% to 10% by weight) to the inner wall part of a long nozzle or a submerged nozzle in continuous casting of very low carbon steel for which carbon pick-up should be avoided.

The nozzle for continuous casting according to the present invention can be produced by integral molding, for example, as follows.

A mixture of carbon, oxides, nitrides, etc. is kneaded with a binder in a mixer, such as a wet pan, to prepare a mixture for forming an inner wall part. A mixture for forming a nozzle body is similarly prepared by kneading raw materials.

The resulting mixtures are packed into a molding frame. A forming jig is used to adjust the thickness of the inner wall portion. After packing, the jig is removed, and the mixtures are formed by CIP (cold isotactic pressing) or mechanical pressing. Where a slit structure is to be provided, paraffin paper, etc. is set around the jig.

After drying, the resulting green body is fired in a non-oxidative atmosphere. If desired, the fired product is subjected to machining into a final shape.

As described above, the nozzle for continuous casting according to the present invention has its inner wall part made of a refractory material having a carbon content of 1% to 10% by weight, the raw materials of the refractory material other than carbon having a grain size of not greater than 420 $\mu$m, the inner wall part being integrally molded with the nozzle body of the nozzle, and the inner wall part having a thickness of 2 mm to 12 mm. The nozzle of the invention is prevented from clogging by alumina deposition and can be produced by integral molding.

The present invention will now be illustrated in greater detail by way of Examples and Comparative Examples, but it should be understood that the present invention is not construed as being limited thereto. Unless otherwise noted, all the percents are given by weight.

EXAMPLES 1 TO 7 AND COMPARATIVE EXAMPLES 1 TO 4

Graphite and other raw materials selected from alumina, mullite, magnesia, cordierite, silicon nitride, and boron nitride were kneaded with a phenolic resin binder and molasses according to the formulation shown in Table 1 below in a wet pan to prepare a plastic body.

The resulting plastic body was formed by CIP under a pressure of 1.0 t/cm$^2$, and the green body was fired at 1000° C. for 3 hours in a non-oxidative atmosphere. Test specimens (25×25×250 mm) were cut out of the fired product. The apparent porosity, bulk specific gravity, and flexural strength of the specimen are shown in Table 1.

An alumina deposition test was carried out as follows. Aluminum killed steel having an aluminum content of 0.025% was melted in an RF induction heating furnace in an argon gas atmosphere, and 1% of aluminum was further added thereto. The test specimen was vertically put in the molten steel to a depth of 120 mm and kept rotated at 10 rpm for 50 minutes. After pulling up, the specimen was cut into halves longitudinally. The thickness of alumina deposit on each of opposite sides of the specimen 50 mm above the lower end was measured to obtain an average. The results obtained are shown in Table 1.

TABLE 1

| | Example No. | | | | | | | Compara. Example No. | | | |
|---|---|---|---|---|---|---|---|---|---|---|---|
| | 1 | 2 | 3 | 4 | 5 | 6 | 7 | 1 | 2 | 3 | 4 |
| Raw Material (wt %) | | | | | | | | | | | |
| Graphite | 8 | 5 | 2 | 1 | 5 | 7 | 5 | 15 | — | 4 | 4 |
| Alumina | 92 | 95 | — | 50 | — | 13 | 65 | 85 | 100 | 96 | — |
| Mullite | — | — | 98 | 49 | 90 | — | — | — | — | — | 96 |
| Magnesia | — | — | — | — | 5 | — | — | — | — | — | — |
| Cordierite | — | — | — | — | — | — | 30 | — | — | — | — |
| Silicon nitride | — | — | — | — | — | 50 | — | — | — | — | — |
| Boron nitride | — | — | — | — | — | 30 | — | — | — | — | — |
| Grain Size (G) Distribution (%) | | | | | | | | | | | |
| 420 $\mu$m < G | — | — | — | — | — | — | — | — | — | 30 | — |
| 44 $\mu$m < G ≦ 420 $\mu$m | 55 | 55 | 40 | 60 | 60 | 20 | 55 | 60 | 60 | 40 | 40 |
| 1 $\mu$m < G ≦ 44 $\mu$m | 45 | 45 | 55 | 40 | 40 | 70 | 45 | 40 | 40 | 30 | 35 |
| G ≦ 1 $\mu$m | — | — | 5 | — | — | 10 | — | — | — | — | 25 |
| Binder (%)** | | | | | | | | | | | |
| Phenolic resin | — | — | 6 | 8 | — | — | — | — | — | — | — |
| Molasses | 7 | 6 | — | — | 6 | 10 | 6 | 10 | 6 | 6 | 10 |
| Apparent Porosity (%) | 21.4 | 22.0 | 22.3 | 21.0 | 22.8 | 25.0 | 20.2 | 19.7 | 22.9 | 19.0 | 24.9 |
| Specific Bulk Density | 2.80 | 2.83 | 2.40 | 2.69 | 2.44 | 1.96 | 2.30 | 2.70 | 2.90 | 2.88 | 2.38 |
| Flexural Strength (MPa) | 5 | 6 | 5 | 6 | 7 | 7 | 6 | 7 | 5 | 3 | 7 |
| Thickness of Alumina Deposit (mm) | 0.7 | 0.6 | 0.3 | 0.2 | 0.3 | 0.6 | 0.2 | 2.8 | 0.2 | 0.4 | — |

Note:
*As for raw materials other than graphite.
**Expressed in terms of outer percentage.

It can be seen from the results in Table 1 that the thickness of alumina deposit on the samples of Examples 1 to 7 (graphite content: 1% to 8%) is about ¼ or less of that observed on the sample of Comparative Example 1 (graphite content: 15%), proving the nozzle according to the present invention to be greatly effective in preventing alumina deposition.

Although Comparative Example 2 is equal or even superior in alumina deposit preventive effect to Examples 1 to 7, the sample of Comparative Example 2 after the test was found to have developed cracks that seem ascribed to thermal spalling in the inside of the sample, proving inferior in spalling resistance.

The sample of Comparative Example 3 is made of coarse grains and has weak strength, and the grains fell off during sample preparation or while immersed in molten steel in the alumina deposition test.

The sample of Comparative Example 4 is, on the other hand, made of fine grains. It underwent sintering and developed cracks while immersed in molten steel and was destroyed. Therefore, the thickness of alumina deposit was unmeasurable.

EXAMPLES 8 TO 11 AND COMPARATIVE EXAMPLES 5 TO 8

Submerged nozzles were produced by applying each of the refractory materials of Examples 1, 2, 3 and 6 and Comparative Example 1 to the inner wall part coming into contact with molten steel as shown in FIG. 1. The nozzle has a nozzle body 10, an inner wall part 11, a powder line material 12, and spouts 13 for feeding molten steel.

The inner wall part 11 and the other parts were integrally molded by a CIP forming method under a hydrostatic pressure of 1.0 t/cm$^2$. The thickness of the inner wall part 11 was about 5 mm. The resulting green body was fired at 1100° C. for 3 hours in a non-oxidative atmosphere, and the fired product was subjected to machining to obtain a submerged nozzle shown in FIG. 1.

The resulting submerged nozzles were tested on an actual continuous casting machine as follows.

A 2-strand type continuous casting machine was used. The nozzle of Example was fitted to No. 1 strand (1st), and the nozzle of Comparative Example to No. 2 strand (2st). Each run was conducted up to 5 charges (hereinafter, ch). After the test, the nozzle was removed, vertically cut into halves, and the thickness of alumina deposit was measured at three points in the straight portion of the inner wall to obtain an average. The casting conditions and the thickness of alumina deposit are shown in Table 2. The steel species used in the casting test had a composition of, in average, C: about 0.01 wt %; Mn: about 0.3 wt %; Al: about 0.03 wt %; and N 0.004 wt %.

TABLE 2

| Run No. | Strand | Example No. | Refractory Material | Casting Time (min) | Number of Casting ch | Thickness of Deposit (mm) | Remark |
|---|---|---|---|---|---|---|---|
| 1 | 1st | Example 8 | Example 1 | 250 | 5 | 1.5 | — |
| | 2st | Compara. Example 5 | Compara. Example 1 | 250 | 5 | 4.1 | — |
| 2 | 1st | Example 9 | Example 2 | 271 | 5 | 1.0 | — |
| | 2st | Compara. Example 6 | Compara. Example 1 | 220 | 4 | 13.8 | Casting was stopped at 4 ch due to nozzle clogging |
| 3 | 1st | Example 10 | Example 3 | 264 | 5 | 0.5 | — |
| | 2st | Compara. Example 7 | Compara. Example 1 | 264 | 5 | 5.5 | — |
| 4 | 1st | Example 11 | Example 6 | 280 | 5 | 1.1 | — |
| | 2st | Compara. Example 8 | Compara. Example 1 | 380 | 5 | 10.9 | — |

The results in Table 2 provide confirmation that alumina deposition in Examples 8 to 11 was slight even after 5 ch casting.

To the contrast, considerable alumina deposition was observed in Comparative Examples 5 to 8. In Comparative Example 6 (Run No. 2), clogging of the nozzle become serious during 4 ch casting so that casting was stopped.

EXAMPLES 12 TO 17 AND COMPARATIVE EXAMPLES 9 TO 10

Submerged nozzles having a slit structure as shown in FIG. 2 (Examples 12, 14 and 16 and Comparative Example 9) and those having no slit structure (Examples 13, 15, and 17 and Comparative Example 10) were produced by applying each of the refractory materials of Examples 3, 4 and 5 and Comparative Example 1 to the inner wall part. In FIG. 2, the nozzle has a (outer) nozzle body 20, an inner wall part 21, a powder line material 22, spouts 23 for feeding molten steel, and a slit 24. The length of the slit 24 was ⅔ of the total length of the straight portion of the inner wall part 21 (shown by "A"). The thickness of the inner wall part was about 7 mm, and thickness of the space (slit 24) was 0.8 mm.

The resulting submerged nozzles were subjected to a casting test using a 1-strand type continuous casting machine. Each run was conducted up to 4 ch. After the test, the nozzle was removed, vertically cut into halves, and the thickness of alumina deposit was measured at three points in the straight portion of the inner wall to obtain an average. The casting conditions and the thickness of alumina deposit are shown in Table 3 below. The steel species used in the casting test had a composition of, in average, C: about 0.02 wt %; Mn: about 0.2 wt %; Al: about 0.04 wt %; and N: about 0.004 wt %.

TABLE 3

| Run No. | Example No. | Refractory Material | Slit | Casting Time (min) | Number of Casting ch | Thickness of Deposit (mm) | Remark |
|---|---|---|---|---|---|---|---|
| 5 | Example 12 | Example 3 | provided | 241 | 4 | 0.8 | — |
| 6 | Example 13 | " | not provided | 241 | 4 | 1.3 | — |
| 7 | Example 14 | Example 4 | provided | 232 | 4 | 1.0 | — |
| 8 | Example 15 | " | not provided | 70 | 1 | — | Longitudinal cracks developed in the initial stage of 2 ch |
| 9 | Example 16 | Example 5 | provided | 236 | 4 | 1.1 | — |
| 10 | Example 17 | " | not provided | 236 | 4 | 1.4 | — |
| 11 | Compara. Example 9 | Compara. Example 1 | provided | 244 | 4 | 9.1 | Considerabie clogging |
| 12 | Compara. Example 10 | Compara. Example 1 | not provided | 244 | 4 | 11.0 | Considerable clogging |

As is shown in Table 3, reduction in alumina deposition was confirmed in Examples 12 to 17. There was a tendency that alumina deposition on the nozzles with a slit structure is less than on those having no slit structure, while the refractory material forming the inner wall part being the same.

Although the material of Example 4 has a small carbon content (1%) and the nozzles made of it (Examples 14 and 15) are expected to exhibit poor spalling resistance, the nozzle with a slit structure (Example 14) sufficiently serves with no crack development. On the other hand, the nozzle having no slit (Example 15) suffered longitudinal cracks in the initial stage of 2 ch, and the casting test had to be stopped. The nozzles of Comparative Examples 9 to 10, while safe in terms of crack development, suffered from considerable alumina deposition.

While the invention has been described in detail and with reference to specific examples thereof, it will be apparent to one skilled in the art that various changes and modifications can be made therein without departing from the spirit and scope thereof.

What is claimed is:

1. A nozzle for continuous casting comprising an inner wall member coming into contact with molten steel and an outer nozzle body, wherein said inner wall member is made of a refractory material having a carbon content of 1% to 10% by weight; a material other than carbon in the refractory material has a grain size of not more than 420 $\mu$m; said inner wall member is integrally molded with the outer nozzle body to form an integral structure; and said inner wall member has a thickness of 2 mm to 12 mm;

wherein said refractory material forming said inner wall member comprises carbon and an oxide; and wherein said oxide contains cordierite in an amount of 5% to 70% by weight.

2. The nozzle for continuous casting according to claim 1, wherein said refractory material forming the inner wall member further comprises (A) a nitride, (B) a nitride and an oxynitride, or (C) an oxynitride.

3. The nozzle for continuous casting according to claim 1, wherein a space is provided on the outer side of said refractory material of said inner wall member to form a slit structure.

4. The nozzle for continuous casting according to claim 1, wherein a space is provided on the outer side of said refractory material of said inner wall member to form a slit structure.

5. The nozzle for continuous casting according to claim 2, wherein a space is provided on the outer side of said refractory material of said inner wall member to form a slit structure.

6. The nozzle for continuous casting according to claim 1, wherein said refractory material has a carbon content of 1% to 8% by weight.

7. The nozzle for continuous casting according to claim 1, wherein the material other than carbon in the refractory material has such a grain size distribution that the proportion of grains of 1 $\mu$m or less is not more than 20% by weight, that of grains of more than 1 $\mu$m and not more than 44 $\mu$m is 10% to 90% by weight, and that of grains of more than 44 $\mu$m and not more than 420 $\mu$m, each based on the total weight of the material other than carbon in the refractory material.

* * * * *